United States Patent [19]

O'Hara

[11] Patent Number: 4,484,527

[45] Date of Patent: Nov. 27, 1984

[54] CONVERTIBLE RAILWAY HOPPER CAR

[75] Inventor: James C. O'Hara, St. Louis, Mo.

[73] Assignee: ACF Industries, Inc., New York, N.Y.

[21] Appl. No.: 401,190

[22] Filed: Jul. 23, 1982

[51] Int. Cl.[3] ..... B61F 1/10; B61F 1/14; B61D 7/00

[52] U.S. Cl. ..... 105/247; 105/406 R; 105/420

[58] Field of Search ..... 105/243, 247, 248, 404, 105/420, 421, 406 R

[56] References Cited

U.S. PATENT DOCUMENTS

| | | | |
|---|---|---|---|
| 2,648,293 | 8/1953 | Dorey | 105/243 |
| 3,557,714 | 1/1971 | Marulic et al. | 105/247 X |
| 4,206,709 | 6/1980 | Jantzen et al. | 105/243 |

*Primary Examiner*—Robert B. Reeves
*Assistant Examiner*—David F. Hubbuch
*Attorney, Agent, or Firm*—Henry W. Cummings

[57] ABSTRACT

A convertible open top hopper car (10) is assembled by longitudinally aligning a pair of railway car stub sills (12) in an assembly position. Transversely extending shear plates (16) are attached to each stub sill. A transversely extending inclined locating plate (18) is integrally connected to the inner end portion of each stub sill. The locating plate preferably includes a flange portion (22) adapted to receive a desired hopper car bottom (24). The bottom may be a conventional gondola bottom having pivoting doors, a light weight gondola bottom for use in cars which are rotated 180° to unload the lading, or a gondola bottom having rapid discharge doors. The bottom selected for application is preferably first attached at each of its ends to the longitudinally spaced locating plates (18). Then hopper car sides (40) including side sills (42) and side sheets (46) are lowered onto the respective shear plates (16) and are welded to the shear plates. Then hopper car ends (60) including end slope sheets (62, 74) and vertical beams (110) to react the impact turning moment are connected to the shear plates and stub sills. A vertical bolster web (34) extending between the shear plate and the end slope sheet may be sub-assembled with the stub sill or with the end slope sheets.

10 Claims, 11 Drawing Figures

CONVERTIBLE RAILWAY HOPPER CAR

BACKGROUND OF THE INVENTION

It is well known in the railway car art to provide a railway car which is convertible from a hopper car with bottom doors to a car with a flat bottom with foldable members which form the bottom. An example of such a car is found in U.S. Pat. No. 2,648,293.

In assembling railway freight cars, it is expensive to provide a line, or a series of assembly positions, for each type of car which is to be manufactured. For example, if different types of coal cars are to be manufactured, it would be expensive to provide a line to manufacture each type of coal car.

It would be desirable to provide a line for the assembly of coal cars in which different types of coal car bottoms could be utilized and assembled in a single line with common stub sills, sides and end structures. Such a line would enable the production of stock sub-assemblies of stub sills, sides, end structures and hopper bottoms. The customer may then select the type of coal carrying bottom he desires. Such an assembly procedure offers considerable economic benefits over the use of a separate line for each type of coal car.

In U.S. Pat. No. 4,206,709, a covered hopper car is disclosed which is convertible from a liquid carrying hopper car to a conventional hopper car adapted to carry particulate solid lading. However, this covered hopper car patent gives no teaching of the sub-assembly of stub sills, sides and ends in a single line, and the liquid carrying bottom is replaced with a pneumatic hopper outlet.

SUMMARY OF THE INVENTION

A convertible open top railway car is assembled by longitudinally aligning a pair of railway car stub sill subassemblies in an assembly position. Transversely extending shear plates are attached to each stub sill. An inclined transversely extending locating plate is integrally connected to the inner end portion of each stub sill. The locating plate preferably includes a flange portion adapted to receive a selected rail car bottom. For example, the bottom may be a conventional hopper car bottom having pivoting doors, a light weight gondola bottom for use in cars which are rotated 180° to unload the coal, or a bottom having rapid discharge doors. The bottom selected for application is preferably first attached at each of its ends to the longitudinally spaced locating plates. Then car side subassemblies including side sills and side sheets are lowered onto the respective shear plates and are welded to the shear plates. Then car end sub-assemblies including end slope sheets and vertical beams to react the impact turning moment are connected respectively to the shear plates and stub sills. A vertical bolster web extending between the shear plate and the end slope sheet may be sub-assembled with the stub sill or with the end slope sheets.

IN THE DRAWINGS

FIG. 1*a* is a side elevation view of the left side and external portion of a railway hopper car assembled according to the present invention.

FIG. 1*b* is a vertical sectional view along the longitudinal center line and illustrating the right hand portion of the car.

FIG. 5*a* is a vertical sectional view of the left hand portion of an open top railway hopper car according to the present invention and illustrating an embodiment wherein the car is unloaded through a plurality of pivoted doors.

Figure 5B:
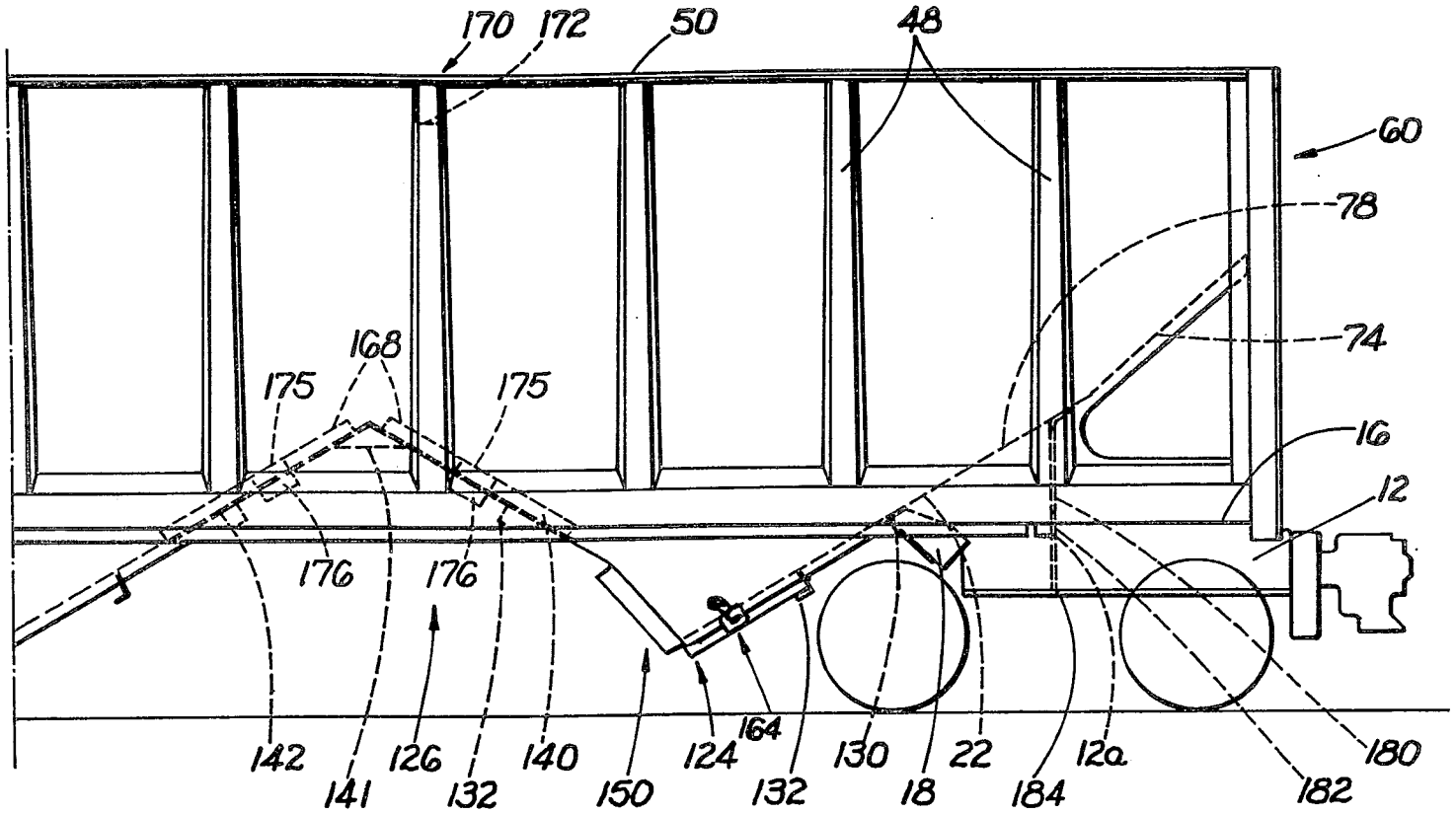

FIG. 5*b* is a view of the right hand portion of the car illustrated in FIG. 5*a* and illustrating the outside portion of the car.

Figures 2, 3, 4, 6, 7, 8, 9:
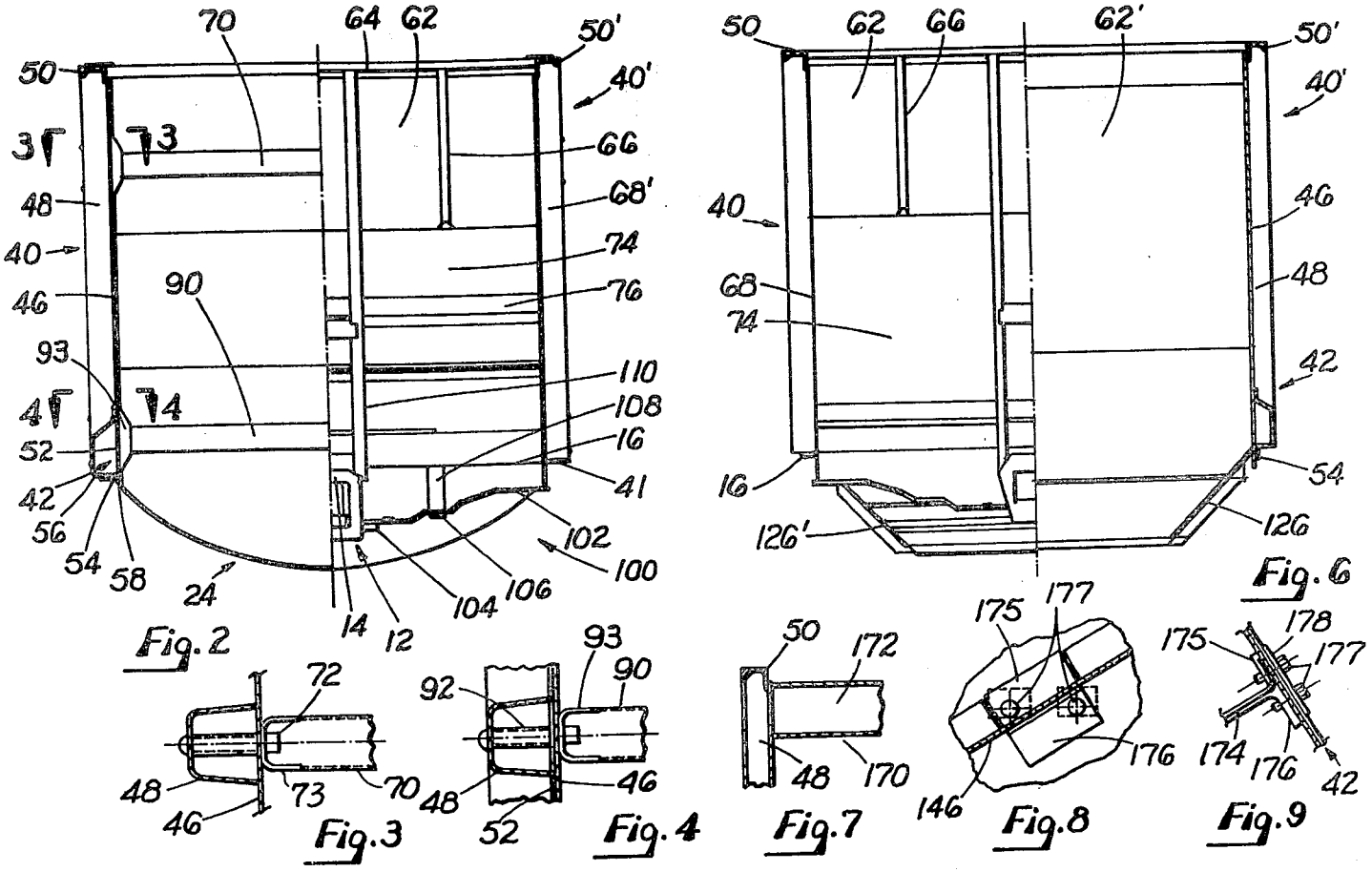
FIG. 2 is a dual sectional view with the right hand portion illustrating the end portion of the car and the left hand portion of FIG. 2 being a vertical sectional view through the midportion of the car.
FIG. 3 is a horizontal sectional view looking in the direction of the arrows along the line 3—3 in FIG. 2.
FIG. 4 is a vertical sectional view looking in the direction of the arrows along the line 4—4 in FIG. 2.

FIG. 6, right side, is a vertical sectional view of the midportion of the car, and FIG. 6, left side, is an end view of the car.

FIG. 7 is a vertical sectional view illustrating the connection of the transverse reinforcement with the side reinforcement.

FIG. 8 is a detailed sectional view illustrating the connection of the flange portions of the bottom sheets to the side sheets.

FIG. 9 is a view illustrating the connection of the inclined sheet flange portions to the upper portion of the side sill.

DESCRIPTION OF PREFERRED EMBODIMENTS

The railway hopper car of the present invention is indicated in the drawings generally at 10. This railway hopper car includes a pair of stub sills 12 and 12' located at either end of the car. Each of the stub sills includes a striker plate 14, 14' and receives a coupler and graft gear of conventional construction. Shear plates 16, 16' are welded onto the upper surface of each of the stub sills. These shear plates extend transversely all the way across the car. Locating plates 18, 18' are connected at the inner end of each of the stub sills 12, 12'. Locating plates 18 and 18' are inclined and are held in place by means of gussets 20, welded to the inner ends of each of stub sills 12 and 12'.

During assembly the shear plates 16, 16' and the locating plates 18, 18' are attached to the stub sills 12, 12' in a sub-assembly operation. Then the thus formed stub sill assemblies are longitudinally aligned. Locating plates 18, 18' respectively include flange portions 22, 22' for connection of a gondola bottom.

Figure 1A:
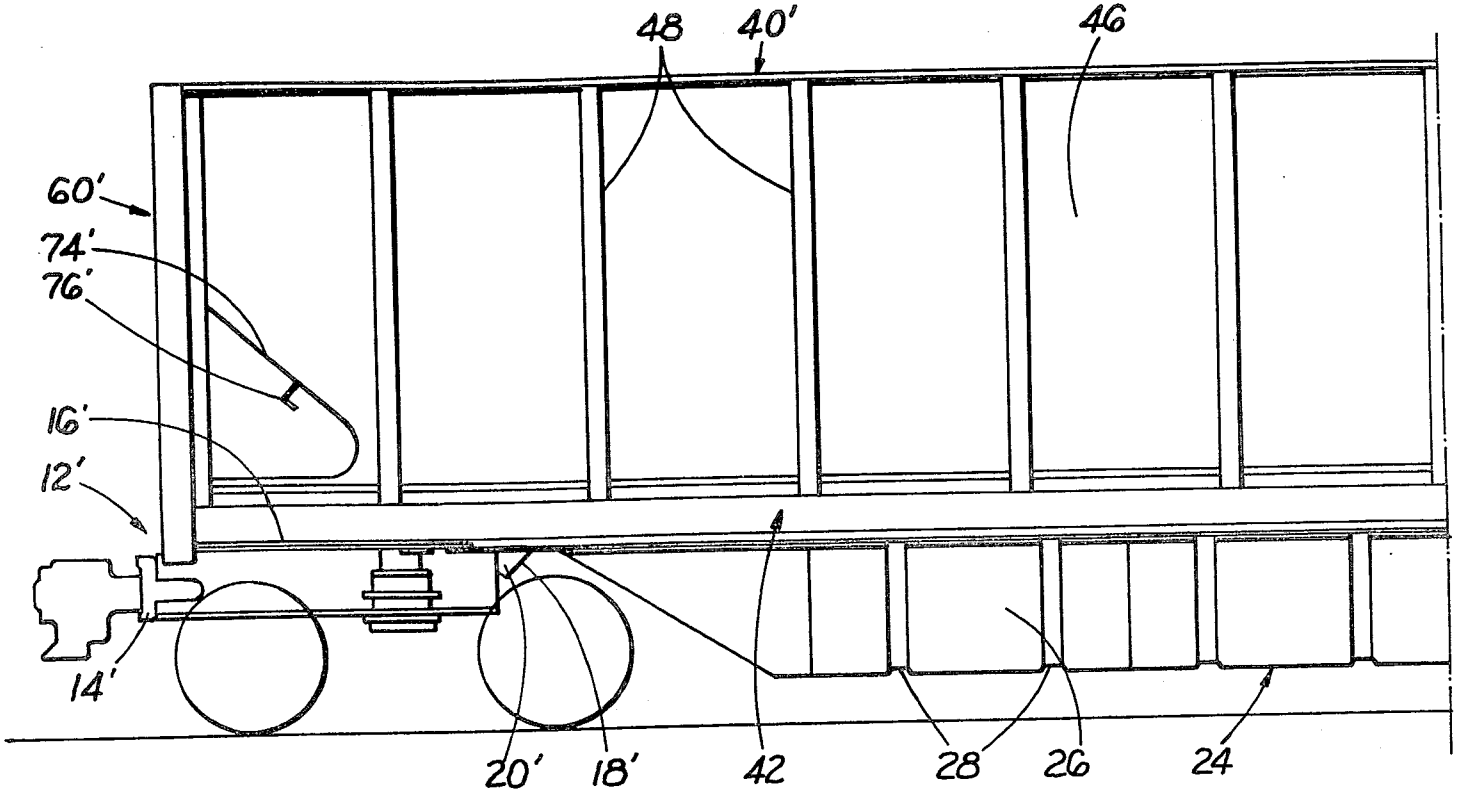

In accordance with one embodiment of the present invention, a gondola bottom indicated generally at 24 is then attached to the locating plates 18, 18'. This gondola bottom 24 includes a curved body portion 26 of a circular segment and may or may not include a plurality of formed reinforcements therein 28. The bottom 24 also includes a pair of upwardly extending transverse connecting plates 30 (FIG. 1*a*) welded to body portion 26 and having a transverse reinforcing angle 32. Plates 30 are welded to flange portion 22 of locating plates 18. With this type of gondola bottom with no doors, the car must be rotated 180° to unload the lading, normally coal.

After connecting the bottom 24 to the locating plates 18 and 18' car body sides indicated generally at 40, 40' are lowered into position on shear plates 16, 16, on either side of the car. Each of the car body sides 40, 40' includes a side sill 42, a vertically extending sheet 46, and a plurality of vertical stiffeners 48 of channel cross section (FIGS. 3 and 4). Since the shear plate 16 projects outwardly, it is not a difficult operation to lower the sides 40 and 40′ into position. FIG. 2 (right hand side) shows the side 40′ resting upon the shear plate 16, and welded thereto at 41. Sides 40, 40′ further include transversely spaced top plates 50 and 50′. It will be noted that side sheets 46 extend downwardly and engage flange portions 52 and 54 of side sill body member 56. See FIG. 2, left side.

After the sides have been located upon the shear plates 16, 16′ and have been welded thereto, the bottom 24 is welded to the side sill 42. Preferably, the bottom is welded to an extension 58 of the side sheet 46, as shown in the left hand side of FIG. 2.

In addition, the transversely extending reinforcements 70 and 90 are provided between sides 40 and 40′. Transverse reinforcements 70 and 90 are conveniently formed of rectangular tubing. The transversely extending reinforcements 70 and 90 are connected to the vertical stiffeners 48 by means of Huck fasteners 72 and a collar 73 (FIG. 3).

Transverse stiffeners 90 are attached to vertically extending reinforcements 48 by means of Huck fasteners 92 which may be of the same type as Huck fasteners 72, and a collar 93. (FIG. 4).

After the attachment of reinforcements 70 and 90, end assemblies 60 and 60′ are then attached to the respective ends of the car. As shown in FIG. 2, the end structure includes a vertical end sheet 62 which is connected at its upper end to a channel end member 64. Vertical reinforcements 66 are provided for the end sheet 62. The end structure further includes a pair of vertically extending columns 68 and 68′ located on either side of the car. These columns extend from the channel member 64 to the shear plate 16 which includes an upwardly extending extension 16*a*, (FIG. 1*b*) which is connected to the columns 68 and 68′.

End structure 60 further includes an inclined slope sheet 74, 74′ having an angle shaped reinforcement 76, 76′ extending transversely of the car. Slope sheet 74 is either bent or welded to another inclined slope sheet portion 78. The lower edge 80 of slope sheet 78 is welded to flange portion 22 of locating plate 18. (FIG. 1*b*)

Figure 1B:
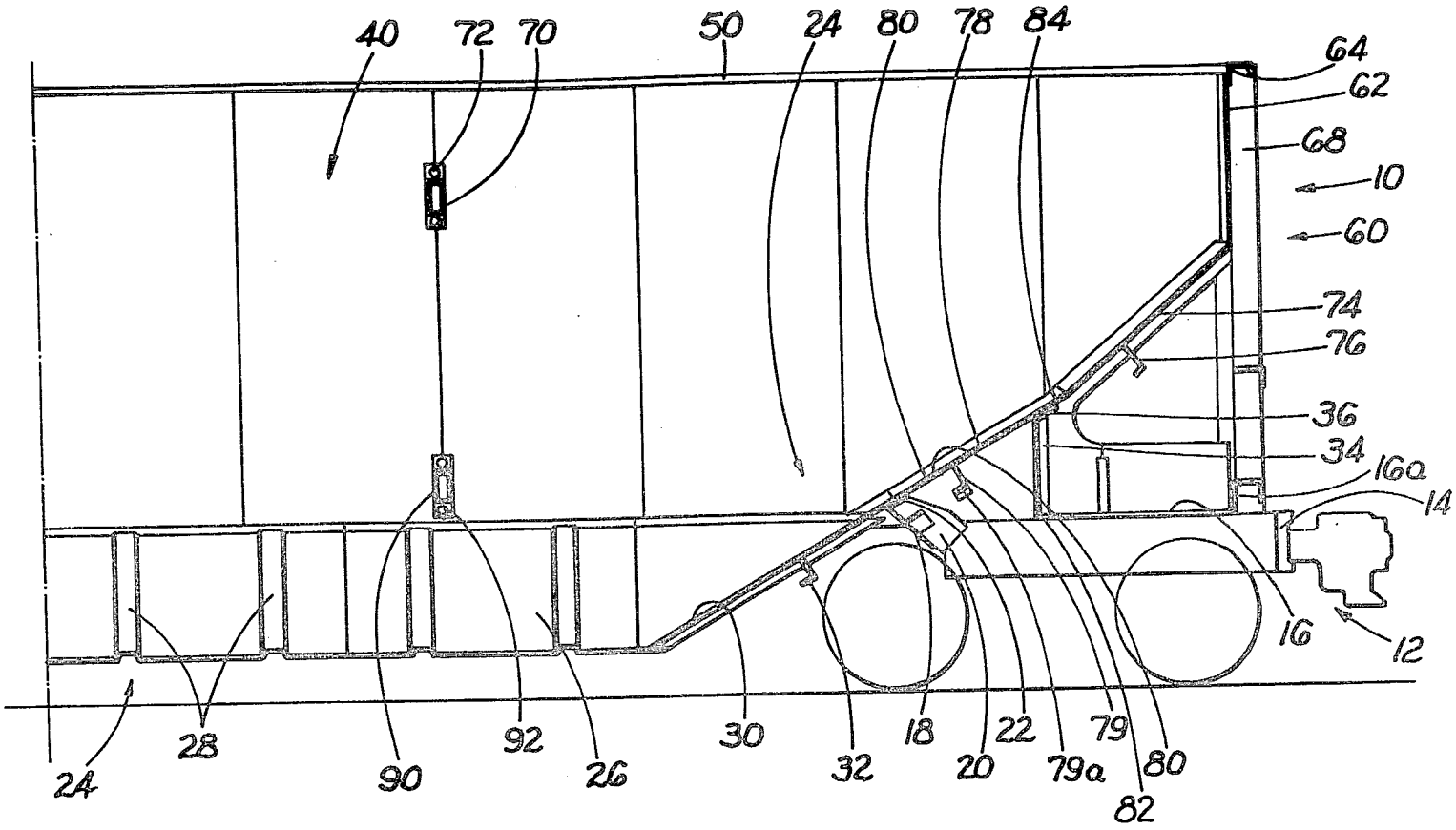

In one construction, vertical bolster web member 34 may be welded to sheet 78 in sub-assembly including flange portion 36 to facilitate this welding (FIG. 1*b*). When the end structure is applied, the bolster web 34 is preferably welded to the stub sill 12 at the inner end of the shear plate 16 as indicated at 82. Slope sheet portion 78 includes a stiffener 79 extending transversely of the car. At either side a slip 79*a* is attached to facilitate welding to the sides 40, 40′ of the car.

In addition, a pair of vertical columns 110 are provided at each end of the car which extend from the end slope sheet 62 to the stub sill 12. These columns react the turning moment caused by coupler impacts applying a load into the stub sill and then upwardly into the vertical bolster web 34 and into end sheet 62.

The car body further includes a bolster assembly 100 including a lower bolster plate 102 which is connected to the stub sill 12 by means of flange 104. A side bearing 106 is also attached to lower bolster plate 102 which preferably is of the constant contact type. A side bearing support 108 is provided which engages the shear plate 16.

With the end structure thus assembled and welded in place, a completed open top railway hopper car is provided. In this embodiment a light weight reinforced circular segment gondola bottom is provided. In use, the lading, normally coal, is loaded into the car from above. The lading is unloaded by rotating the car 180°.

FIGS. 5*a* and 5*b* and 6 illustrate the application of the invention to attachment of a railway hopper car bottom 124 having connecting plates 130, 130′ which are welded to respective locating plates and flange portions 22 and 22′. In addition to plates 130 and 130′, bottom 124 includes a plurality of downwardly extending plates 140, 142, 144 and 146. Brace plates 141 and 145 extend respectively between inclined plates 140 and 142, 144 and 146. A plurality of transversely extending angle reinforcements 132, 132′ are provided for each of the inclined plates 130, 140, 142, 144, 146 and 130′.

At the lower ends of each of the inclined slope plates are located a plurality of discharge doors 150, 152, and 154.

The particular construction of the doors 150, 152 and 154 is not critical to the present invention. However, each of the doors includes a hinge 156 and a door body portion 158 which engages in closed position a door stop 160. A door latch 162 holds the doors in closed position in transit. Release means 164 for releasing this latch at destination are provided whereby the doors may be unloaded.

After the bottom 124 is welded to the locating plates 18 and 18′, and is thus located between the stub sills 16 and 16′, the sides 40 and 40′ are lowered into position and rest upon the respective shear plates 16 and 16′ as shown in the left hand side of FIG. 6. The sides include side sheets 46, vertical reinforcements 48, side sills 42 and top plates 50 as described in connection with FIGS. 1 and 2. Bottom 124 includes door slope sheets 126, 126′ located on either side of the door.

Slope sheets 126, 126′ are welded to the side sills 42 in the manner illustrated in FIG. 6. In particular, slope sheet 126 is welded to side sheet extension 58. In the same location, the side sill flange portion 54 is welded to sheet 46.

Inclined plates 130, 130′, 140, 142, 144 and 146 are further provided with flange portions 175, 176 which are welded to the slope sheet sides 46 and 46′ on either side of the car after the sides are lowered in place. Huck bolts 177 are used to connect these flange portions 175 and 176 to the upper side sill portion 178 as shown in FIGS. 8 and 9.

Transverse reinforcements 170 and 190 are also provided. They are constructed of rectangular tubes 172 and 192 which are welded to top cords 50 and vertical reinforcement members 48 as indicated in FIG. 7. The connection of transverse reinforcement 190 to the side sill 42 is the same as that for transverse reinforcement 170 and therefore this is not shown in sectional view.

After the sides have been welded to shear plates 16, 16′ and the bottom portion 126 welded to the side sills 42, the end structure 60 is then located in place at opposite ends of the car. The ends 60 and 60′ are of the same construction as described in connection with the embodiment in FIGS. 1 and 2. Very briefly, the end structure includes end columns 68 and 68′, vertical end sheets 62, vertical reinforcements 66, and end slope sheets 74 and 78.

In this embodiment, a pair of single vertical bolster webs 180 and 180′ are respectively welded to slope sheet portions 78 and 78′ in sub-assembly, and when the ends are connected the webs 180 are welded to the inner ends of the shear plate 16 as indicated at 182 and 182′.

Moreover, in this embodiment, an opening 12*a* is provided in the stub sill 12 and the plate 180 extends all the way down to the lower stub sill plate 12*b*, and is welded thereto at 184, 184'.

As described in regard to FIGS. 1 and 2, the plate 180 may be assembled as part of the end or as an alternative, it may be applied to the stub sill 12, 12' as a stub assembly and plate 78 attached thereto at the ends.

However, it will be seen that the embodiment shown in FIGS. 5*a*–9 illustrates how a hopper bottom including pivotable doors may be attached as an alternative to the gondola light weight bottom 24 shown in FIGS. 1–4.

It will be apparent from the foregoing, any desired type of bottom may be utilized with the assembly technique of the present invention so long as it contains a pair of upwardly extending plates of the type 30 or 130, which can be readily connected by welding or with heavy duty fasteners to the locating plates 18 and 18' located on the inner end of each stub sill. Furthermore, the bottom probably has slope sheet portions which can be readily attached to the side sills. Thus the present invention is not to be limited to the particular bottoms illustrated, but may be these or other appropriate bottoms, including a hopper bottom having rapid discharge doors for rapid unloading of the lading.

What is claimed is:

1. A railway hopper car comprising: a pair of longitudinally aligned railway car stub sills; a pair of transversely extending shear plates, each shear plate attached to a respective said stub sill; each said shear plate extending inboard to generally the midportion of its respective stub sill; gusset means extending inwardly from end portions of each said stub sill; at least one pair of transversely extending, longitudinally spaced locating plates, each locating plate attached to a respective said gusset means a hopper bottom attached at each of its ends to said longitudinally spaced locating plates; hopper car sides including side sills and vertically extending side sheets located on the respective shear plates and integrally connected to said shear plates; hopper car ends including end slope sheets connected to each of said locating plates and vertical beam means extending respectively between said end slope sheets and said stub sills to react the turning moment applied to said stub sills by coupler impact and squeeze loads.

2. An open top hopper rail car according to claim 1, including a flange portion on each said locating plate adapted to receive an upwardly extending plate portion of the hopper bottom.

3. A railway hopper car according to claim 1, wherein said bottom includes pivoting doors.

4. A railway hopper car according to claim 1, wherein said bottom comprises a gondola bottom which is rotated approximately 180° for unloading.

5. A railway hopper car according to claim 1, wherein said bottom includes rapid discharge doors.

6. An open top railway hopper car comprising: a pair of longitudinally aligned railway car stub sills; transversely extending shear plates, each shear plate attached to a respective said stub sill and extending inboard generally to the midportion of its respective stub sill; gusset means extending inwardly from end portions of each said stub sill; at least one pair of transversely extending, longitudinally spaced locating plates, each locating plate attached to a respective said gusset means, said locating plates each including a flange portion adapted to receive a desired car bottom; said bottom attached at each of its ends respectively to one of said locating plate flange portions; hopper car sides including side sills and side sheets located on the respective shear plates and integrally connected to said shear plates; hopper car ends including end slope sheets connected to each of said locating plates; and vertical beam means connected between said end slope sheets and said stub sills to react the impact turning moment applied to said stub sills by coupler and squeeze loads.

7. An open top hopper rail car according to claim 6, including a vertical bolster web extending between each shear plate and each end slope sheet.

8. An open top hopper car according to claim 6, wherein said bottom includes pivoting doors.

9. An open top hopper car according to claim 6, wherein said bottom comprises a gondola bottom which is rotated approximately 180° for unloading.

10. An open top hopper car according to claim 6, wherein said bottom includes rapid discharge doors.

* * * * *